United States Patent [19]

DerMott et al.

[11] Patent Number: 4,496,009

[45] Date of Patent: Jan. 29, 1985

[54] THROUGH THE TUBING PERFORATING GUN ASSEMBLY

[75] Inventors: Raymond W. DerMott, Brenham, Tex.; Kenneth J. Hartwein, New Orleans, La.

[73] Assignee: Shell Oil Company/Schlumberger Technology Corp., Houston, Tex.

[21] Appl. No.: 534,014

[22] Filed: Sep. 20, 1983

[51] Int. Cl.[3] ..... E21B 43/116

[52] U.S. Cl. ..... 175/4.52; 175/4.6; 102/310

[58] Field of Search ..... 175/4.5–5.59; 166/55, 63, 297, 299; 102/310

[56] References Cited

U.S. PATENT DOCUMENTS

| | | | |
|---|---|---|---|
| Re. 25,407 | 6/1963 | Lebourg | 175/4.6 |
| 2,965,031 | 12/1960 | Johns | 175/4.52 |
| 2,965,176 | 12/1960 | Brieger et al. | 175/4.52 |
| 3,110,257 | 11/1963 | Lebourg | 175/4.52 |
| 3,366,188 | 1/1968 | Hicks | 175/4.52 |
| 4,194,577 | 3/1980 | Vann | 175/4.52 |
| 4,291,623 | 9/1981 | Robinson et al. | 102/310 |

*Primary Examiner*—James A. Leppink
*Assistant Examiner*—Thuy M. Bui

[57] ABSTRACT

A through the tubing perforating gun assembly having means for separating the upper head from the gun carrier upon firing. This allows the gun carrier to fall to the bottom of the well and eliminates the need to retrieve the carrier. Special charges are used to separate the carrier from the head with the charges being fired simultaneously with the gun charges.

10 Claims, 1 Drawing Figure

THROUGH THE TUBING PERFORATING GUN ASSEMBLY

BACKGROUND OF THE INVENTION

The present invention relates to perforating guns and particularly to a perforating gun assembly that is designed to be run through the tubing string of a well. In particular, the assembly is designed for use in deep wells with high temperatures and high pressures. Temperatures would normally be in excess of 340° F.

In the production of hydrocarbons, both crude oil and natural gas, it is customary to drill a well and install casing if it appears that commercial production can be realized. After the well is cased, it is completed by perforating the casing opposite the production zones. The perforating is done by explosive charges which fire a high energy jet through the casing and into the formation to create drainage paths for the hydrocarbons. In the case of low temperature and relatively low pressure wells, the wells can be perforated using a string of perforating charges that is lowered through the casing and actuated to perforate the casing. The string of expended charges and supporting structure can then be withdrawn from the well and the production tubing string installed and the well produced. In the case of deep wells, it has been customary to first install the production tubing string and then perforate the well by a string of charges that are lowered through the production tubing string. This can be done by either using expendable guns or a hollow carrier, which carries the charges, that can be retrieved. In the case of expendable guns that are lowered through the production tubing string, it is necessary to separate the charge carrier from the wire line used for lowering the charges in order that the carrier may be left in the well bore. Normally, the carrier is designed to fracture into small pieces when the charges are detonated and the pieces fall to the bottom of the well. The system of using charges suspended on a carrier is satisfactory in wells that have temperatures below approximately 300° F., but cannot generally be used in wells above 300° F., due to the temperature effect on the primacord and detonator used in the perforating gun. For higher temperatures a retrievable gun is used, but the hollow carrier is designed with sufficient strength and wall thickness to limit swelling beyond a pre-determined amount. This allows the gun carrier to be retrieved. The size of the carrier of this system limits the charge size and potential perforation penetration (effectiveness).

PREFERRED EMBODIMENT

The present invention solves the above problems by providing a perforating gun assembly in which larger perforating charges are loaded in a smaller steel tube. The outer diameter of the tube is selected so that the complete assembly may be lowered through normal production tubing, i.e., $2\frac{7}{8}$ inch outside diameter tubing and associated downhole tubular accessories and packer (tubing-casing annulus seal). The charges are suspended on a loading strip that also provides support for the primacord for igniting the charges as well as the wire line used for igniting the primacord. The charges in the gun are as large as those used in carriers which would be limited by clearance in deep well designs. This preferred embodiment combines the advantages of the expendable gun; namely, a larger perforating charge with the temperature and mechanical protection provided by a carrier, a carrier which is normally retrievable but has a clearance limitation when loaded with the desired perforating charge. The loading strip is supported from the upper and/or head of the assembly by means of plastic screws, for example, nylon screws which can be easily fractured when the charges are fired. In addition, the steel tube is attached to the head member by means of frangible pins which also fracture upon the firing of the charges. O-rings, or similar sealing devices are used to provide a fluid-tight seal between the steel tube and the head member, as well as between the tube and the bottom closure of the tube. The perforating charges are aligned in the tube so that they face one direction while one or more non-focused charges are loaded in the top of the tube. The non-focused charges are directed in the opposite direction from the perforating charges and are used to separate the tube from the head member. In operation, the complete assembly is lowered through the tubing string into the portion of the well below the tubing string. Since wells normally will have some inclination the assembly is designed to seek the low side of the casing. The assembly is also designed so that when it seeks the low side, the perforating charges will be directed toward this side of the casing while the non-focussed charges will be directed in the opposite direction. This ensures that the non-focused charges will not perforate or otherwise damage the casing. When the charges are fired, the perforating charges will fire first and perforate the casing. The non-focused charges will fire last and separate the tube from the head so that it can fall to the bottom of the hole.

BRIEF DESCRIPTION OF THE DRAWING

The present invention will be more easily understood from the following detailed description of the Preferred Embodiment when taken in conjunction with the attached drawing showing an elevation view partially in section of a perforating gun assembly constructed according to this invention.

PREFERRED EMBODIMENT

Figure 1:
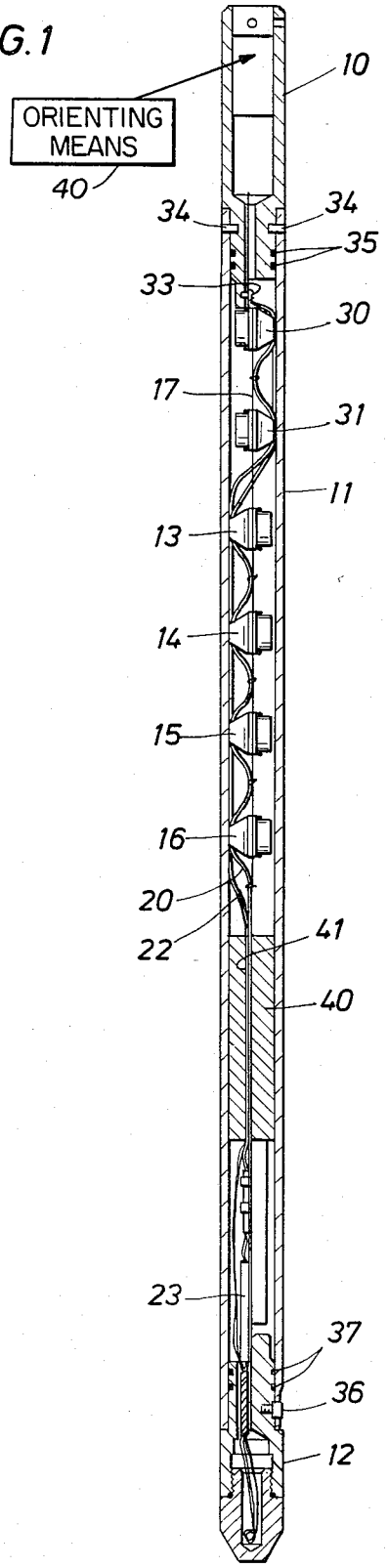

Referring now to the drawing there is shown a perforating gun assembly constructed according to this invention. The assembly utilizes an upper or head member 10 to which the tubular member 11 is attached and a lower end cap 12. As explained above, the tubular member 11 is made of steel and is designed to withstand bore hole pressures without deforming. The tube diameter of that tubular member 11 is chosen so that it can easily be lowered through the well production tubing. For example, a 1.835 inch O.D. tube having a 0.136 inch wall may easily be lowered through a $2\frac{7}{8}$ inch O.D. diameter production string with typical I.D. from 2.441 inch to 1.995 inch. The tube can be formed of any suitable material, for example, a AISI 41xx series steel that is hardened to a Rockwell hardness ($R_c$) of 33 or greater. Perforating charges 13, 14, 15 and 16 are positioned in the tube and attached to the loading strip 17. The perforating charges are preferably 6.5 gram charges used in a 2 inch perforating gun. Also attached to the loading strip are the primacord 20 which is used to fire the charges and the wire conductor 22 used to detonate the firing cap 23 located in the bottom of the tubular member 11 which is sealed by the end cap. The conductor 22 forms part of the wire line which is attached to the head member 10 by conventional means and used for lowering the perforating gun assembly into the well. It should be noted that all the perforating charges 13–16 are directed in a single direction, i.e., to the right, as shown in FIG. 1.

Loaded above the perforated charges 13–16 are two non-focused charges 30 and 31. The charges 30 and 31 are used to separate the tubular member 11 and the end cap 12 and the remaining portions of the system from the head member 10. The charges 30 and 31 are preferably 13 gram non-focused charges. Since the primacord 20 connects to all the charges in series, the charges 30 and 31 will be fired after the perforating charges are fired and not interfere with the perforation of the well casing. The head member 10 is attached or secured to the tubular member 11 by means of two frangible pins 34. The pins are designed so that they can be readily fractured by the fluid inrush resulting from the firing of the charges 30 and 31, yet have sufficient mechanical strenght to support the tubular member 11 and the perforating charges and the remainder of the equipment, as it is lowered into the well. For example, spirol type roll pins may be used. A pair of O-rings 35 are provided for ensuring a fluid-tight seal between the tubular member 11 and the head member 10. The loading strip 17 is attached to the head member by a frangible fastener 33 that may comprise a plastic fastening member such as a nylon cap screw that is easily fractured by the firing of the charges 30 and 31.

The bottom of the tubular member is closed by the end cap 12 which is secured to the tubular member by suitable cap screws 36. A pair of O-rings 37 are provided for assuring a fluid-tight seal between the end cap and the tubular member.

The lower portion of the tubular member is provided with a filler member 40 which has a central opening 41 through which the primacord and the wire may pass. The filler member may be formed of aluminum or similar material and is designed to prevent collapsing or deforming of the lower portion of the tubular member 11. It is necessary to ensure that the tubular member 11 remains substantially straight, so that after separating from the head member 10 it can freely fall to the bottom of the well and not interfere with production from the well. In addition to the filler member 40, the assembly is also provided with an orienting means 40, for example, a magnetic positioning device as a means for orienting it with the low side of the well casing. For example, a magnet located above the head member 10 can be used to roll the tubular member 11 to such a position that the perforating charges 13–16 are directed toward the low side of the casing. This type of orienting equipment is known and in commercial use, for example, the equipment manufactured by Schlumberger Company, Houston, Tex. Other known methods of orienting such as a mechanical sidekicker or sidekicker-magnet combination could be used.

After the tubular member 11 is oriented with the low side of the well, it is held to the well casing by magnetic means.

After the gun assembly has been completely assembled using the frangible pins 34 and the plastic fastening means 33, it can be run in the well. As is explained the 1.835 inch O.D. tubing will pass through $2\frac{7}{8}$ inch production tubing. As the gun exits from the bottom of the production tubing, it will orient itself with the low side of the well casing and attach to the casing by the magnetic means. In orienting itself towards the low side, the perforating charge 13–16 will be directed toward the low side of the casing while the non-focused fracturing charges 30–31 will be directed in the opposite direction. After the gun is fired, the primacord will detonate the perforating charges in an ascending order and finally detonate the two fracturing charges 30 and 31. The detonation of the fracturing charges 30 and 31 will open two one inch holes in the tubular member at the top. This will allow an inrush of well fluids and separate the tubular member from the head member by fracturing the two spirol pins and plastic screw holding the carrier strip. The tubular member will fall to the bottom of the well and not interfere with production from the well. It is important that the fastening means 33 and 34 be easily fractured by the firing of the charges 30 and 31 and the resulting inrush of well fluids and that the filler member 40 be placed at the bottom of the tube, so that the tube is not distorted or bent in a manner that would prevent its falling to the bottom of the well. The fracturing charges 30 and 31 will not interfere with the normal operation of the perforating charges, nor will they damage the well casing, since they are directed in the opposite direction from the perforating charges.

What is claimed:

1. A through the tubing perforating gun assembly comprising:

a uniform non-frangible tubular charge carrier;

an upper head member, said head member being attached to said carrier by frangible means;

a plurality of focused perforating charges, said charges being disposed on a loading strip, said charges being disposed in said carrier and said loading strip being secured to said head member by a frangible means;

at least one non-focused charge disposed at the top of said loading strip for opening a hole in the tubular charge carrier member to allow an inrush of well fluids for fracturing both said frangible means and separating said carrier and said loading strip from said upper head member;

a lower end cap disposed to close the lower end of said carrier; and a filler member disposed in the lower end of said carrier to prevent the collapse of the tubular carrier when said tubular carrier separates from said head member.

2. The through the tubing perforating gun of claim 1 wherein the frangible means used to attach the head to the carrier comprises pins.

3. The through the tubing perforating gun of claim 1 wherein the non-focused charge is directed in the opposite direction from the perforating charges.

4. The through the tubing perforating gun of claim 1 wherein the frangible means used to fasten said loading strip to said head comprises plastic fasteners.

5. The through the tubing perforating gun of claim 1 and in addition means for holding said carrier against the casing wall of the well with the perforating charges oriented toward the casing wall.

6. The through the tubing perforating gun of claim 5 wherein the holding means comprises magnetic means or other directional methods.

7. The through the tubing perforating gun of claim 5 wherein the holding means comprises a mechanical positioning device.

8. The through the tubing perforating gun of claim 7 wherein the mechanical positioning device is a sidekicker.

9. The through the tubing perforating gun of claim 1 wherein the carrier is formed of high strength material capable of withstanding borehole temperatures and pressures.

10. A method for perforating a well bore casing comprising the steps of:

forming a perforating gun by attaching a plurality of focused perforating charges on a loading strip and disposing said loading strip within a non-frangible charge carrier;

fastening the loading strip and the carrier to an upper head member with frangible means;

positioning at least one non-focused charge at the top of said loading strip; and rupturing said charge carrier by exploding said non-focused charge or charges thereby affording the inrush of well fluids for fracturing said frangible means and separating said carrier and said loading strip from said upper head member.

* * * * *